US007069694B2

(12) United States Patent
Fullick

(10) Patent No.: US 7,069,694 B2
(45) Date of Patent: Jul. 4, 2006

(54) LATCH MECHANISM WITH PROTRUSION AND CORRESPONDING POCKET BRACE

(76) Inventor: Ken Fullick, 2519 Bennington La., McHenry, IL (US) 60050

( * ) Notice: Subject to any disclaimer, the term of this patent is extended or adjusted under 35 U.S.C. 154(b) by 0 days.

(21) Appl. No.: 10/325,622

(22) Filed: Dec. 18, 2002

(65) Prior Publication Data

US 2004/0128916 A1 Jul. 8, 2004

(51) Int. Cl.
*E05D 15/22* (2006.01)
*E05C 1/10* (2006.01)

(52) U.S. Cl. ..... 49/183; 49/185; 292/175

(58) Field of Classification Search ..... 49/449, 49/183, 184, 186, 394, 185, 181; 292/174, 292/175, 163, DIG. 37, DIG. 63, 42, DIG. 47
See application file for complete search history.

(56) References Cited

U.S. PATENT DOCUMENTS 1,862,757 A 6/1932 Menns
5,139,291 A * 8/1992 Schultz ..... 292/42
5,671,958 A 9/1997 Szapucki et al.
6,021,603 A * 2/2000 Prete et al. ..... 49/183
6,230,443 B1 * 5/2001 Schultz ..... 49/183

* cited by examiner

*Primary Examiner*—Hugh B. Thompson, II
(74) *Attorney, Agent, or Firm*—Lawrence J. Chaps

(57) ABSTRACT

A latch mechanism, which is coupled to a window sash that travels within a window frame, is adapted for being coupled to a pocket brace, which extends across the channel opening of the jamb pocket of the side jamb. The latch mechanism includes a main housing, a bolt, and a tension device. The main housing has a sidewall, which includes one or more sidewall sections which extends around at least a portion of the housing and defines an interior space, and has an opening in said sidewall at one end of said housing. The sidewall forms a channel within the interior space of the main housing having an end that coincides with said opening. The bolt is substantially located within the housing and travels along the channel, and has a first end which is adapted for extending through the opening of the housing and extending into the side jamb of a window frame. A first end of the bolt has a protrusion, which projects in the direction of travel of the window sash within the window frame. A tension device is coupled between the bolt and the main housing for biasing the bolt toward a position where the bolt extends at least partially through the opening. When the window sash travels within the window frame, the protrusion at the first end of said bolt moves between an engaged position and a disengaged position relative to the window frame.

18 Claims, 4 Drawing Sheets

LATCH MECHANISM WITH PROTRUSION AND CORRESPONDING POCKET BRACE

FIELD OF THE INVENTION

The invention pertains to a latch mechanism adapted for use in a sash window assembly. More specifically, the invention pertains to a latch mechanism which includes a bolt having a protrusion which projects in the direction of travel of the window sash within a window frame at the end of a bolt, which is adapted for extending into the side jambs, and which is adapted for selectively engaging a pocket brace.

BACKGROUND OF THE INVENTION

Tiltable window assemblies have previously incorporated tilt latches at the end of the window sash opposite the pivot bar of the tilt mechanism. The previous latch mechanisms have generally provided additional mechanical support for maintaining the window sash so as to be in plane with the non-tiltable direction of travel of the window sash within the window frame.

Prior tilt latches have included a bolt, which travels within a latch housing, and which selectively engages the side jamb of the window frame. The bolts generally have an angled surface at the end of the bolt and on the side of the bolt, that engages the side jamb. When the angled surface of the bolt engages the side jamb as the window sash moves from a tilted position to a non-tilted position, the angled surface of the bolt causes the bolt to at least momentarily deflect inward until it clears the obstructing portion of the side jamb.

The other side of the end of the bolt that engages the side jamb as the window sash moves from a non-tilted position to a tilted position, is generally perpendicular to the direction of tilting movement. The generally perpendicular side of the bolt, when it engages the obstructing portion of the side jamb does not deflect the bolt, but engages the side jamb and resists movement in a tilting direction. Generally the sash is rotationally locked in a non-tilt position within the window frame until the end of the bolt of the tilt latch, which is generally biased toward engagement, is manually retracted and released from the side jamb. An early example of such a tilt latch is described in Menns, U.S. Pat. No. 1,862,757.

Window can be subjected to extreme weather conditions, where the required response to the extreme weather conditions are often dictated by building codes. Building codes are increasingly requiring that the windows survive increasingly extreme weather conditions. One such example includes high winds or large pressure differentials between indoor and outdoor pressures, which can be associated with tornadoes and/or hurricanes. Windows may also be expected to survive an impact from flying debris.

Historically, accepted wisdom suggested that one open the window slightly during a tornado or a hurricane, so as to provide an air path via which the air pressure on the interior side of the window can more easily be equated to the air pressure on the external side of the window. However, more recently, the generally accepted wisdom now suggests, that one should maintain the window in a closed position. This is because storms, which have high winds, like hurricanes, are often accompanied by rain. By opening the window during such a storm, one may be subjecting the interior of the building to potential water damage, where the pressure equalizing effects are now viewed as having only a marginal effect.

As the requirements become increasingly stringent, the building techniques and the components used in the construction of a window assembly need to keep pace or stay ahead of the stricter standards, in order to be able to sell into the market. Consequently, there is a need to develop building techniques and/or better components and incorporate them into the window assemblies, in order to enhance the integrity of the window, and allow it to withstand greater and greater harmful forces, as required by the building codes.

Many currently used window assemblies include plastic extruded jamb liners, which can deflect when under relatively high levels of stress. Similarly, the top and bottom rails, as well as the stiles of the window sash for many window assemblies are also made from extruded plastic components, which are then welded together at the joints. The plastic extruded top and bottom rails can similarly bow and/or deflect, when significant external forces are applied.

As the window sash bows and/or deflects, the ends of the top and bottom rails can be deflected away from the side jamb toward the center of the window assembly. This in turn can pull the attached tilt latch assemblies away from and out of engagement with the side jamb. As a result, the tilt latch assemblies may no longer prevent the tilt motion of the window sash. Additionally the tilt latch assemblies may no longer anchor the non-pivot point side of the window sash within the window frame. This then becomes a weak point in the window construction, and a likely point for failure, when extreme forces are applied.

Consequently, it would be beneficial to develop a tilt-latch, which resists bowing and/or deflection of the window sash, and which does not readily release from the side jamb when the window sash bows and/or is deflected.

SUMMARY OF THE INVENTION

A latch mechanism adapted for being coupled to a window sash is provided, which travels within a window frame. The latch mechanism includes a main housing, a bolt, and a tension device. The main housing has a sidewall, which includes one or more sidewall sections which extends around at least a portion of the housing and defines an interior space, and has an opening in said sidewall at one end of said housing. The sidewall forms a channel within the interior space of the main housing having an end that coincides with said opening.

The bolt is substantially located within the housing and travels along the channel. The bolt has a first end which is adapted for extending through the opening of the housing and extending into the side jamb of a window frame. A first end of the bolt has a protrusion, which projects in the direction of travel of the window sash within the window frame. The tension device is coupled between the bolt and the main housing for biasing the bolt toward a position where the bolt extends at least partially through the opening. When the window sash travels within the window frame, the protrusion at the first end of said bolt moves between an engaged position and a disengaged position relative to the window frame.

In at least one embodiment of the invention, the protrusion is adapted to engage a cross member, which interrupts at least a portion of a channel opening of a jamb pocket in a side jamb of the window frame, when the window sash is in an engaged position relative to the window frame.

In at least a further embodiment of the invention, an interior surface of the protrusion and an interior contact surface of the cross member are angled in a direction, which biases the window sash in a direction opposite to an applied force, when the force is applied to an external facing surface of the window sash, and when the force is sufficient to bow the window sash and bring the sides of the window sash closer together.

A further aspect of the present invention provides for a pocket brace adapted to be coupled to a window frame including a side jamb having a jamb pocket with a channel opening. The pocket brace includes a cross member, which interrupts a portion of the channel opening, wherein said cross member is adapted to engage a protrusion projecting from the bolt of a latch mechanism, which projects in the direction of travel of the window sash within the window frame.

In a further embodiment of the invention, the pocket brace additionally includes at least one side flange coupled to a respective end of the cross member, which extends around at least a portion of the interior surface of the jamb pocket away from the channel opening.

In a still further aspect of the present invention, a method for supporting a window sash including a latch mechanism within a window frame is provided. The method includes moving a window sash between an opened position and a closed position, while the window sash is in an upright position, and engaging a protrusion at the end of a bolt of a latch mechanism to a window frame when said window sash moves toward a closed position, while the window sash is substantially in plane with the direction of movement of the window sash.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
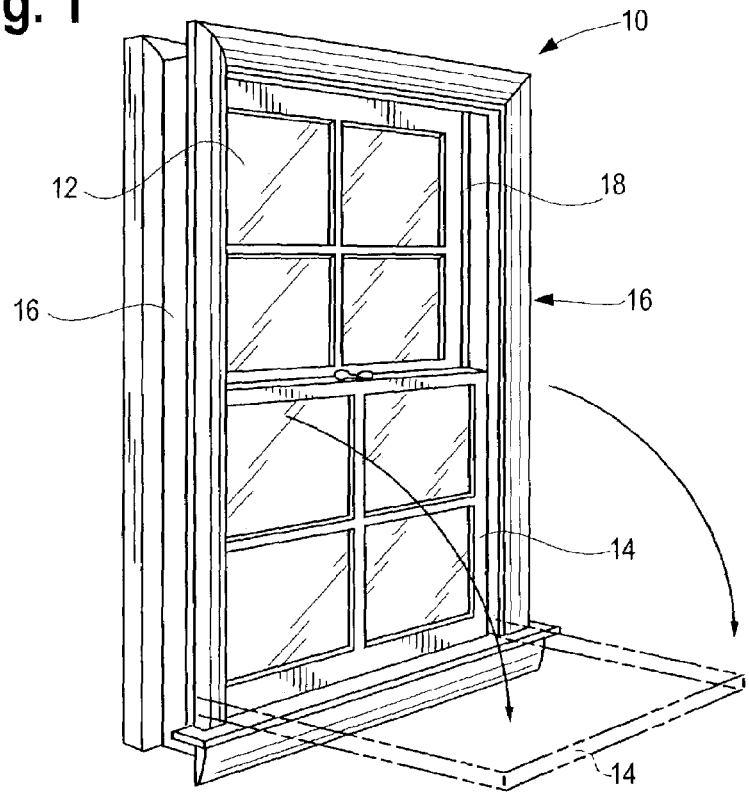
FIG. 1 is a perspective view of a tiltable sash window.

While the present invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

Referring now to the drawings in greater detail, there is illustrated in FIG. 1 a perspective view of a tiltable sash window assembly 10. The window assembly 10 has an upper outer window sash 12 and a lower inner window sash 14, which fit within two oppositely placed side jambs 16. Located within each of the two side jambs 16 is at least one jamb pocket 18. Coupled proximate to the top of each window sash 12, 14 are a pair of latch mechanisms 20 (FIG. 2), which are each located on opposite sides of the window sash 12, 14. The latch mechanisms 20 selectively engage the side jamb and, while engaged, fix the top of the window sash 12, 14 relative to the side jamb 16. In at least some embodiments, within each jamb pocket 18 is located a window sash balance shoe and a tensioning device or spring, which provides a counter balance force for the window sash 12, 14.

Figure 2:
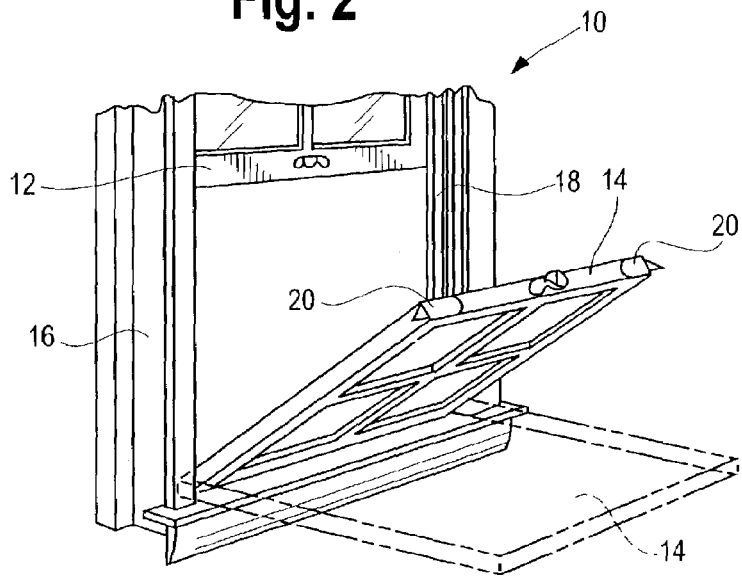
FIG. 2 is a perspective view of the tiltable sash window, illustrated in FIG. 1, with a portion broken away and showing the lower sash being tilted out of the window frame.

The window sashes 12, 14 are coupled to their corresponding window sash balance shoes via a pivot bar, which is attached to the bottom of the window sashes 12, 14. The pivot bar allows the window sash 12, 14 to pivot between a vertical and a horizontal position as shown in FIGS. 1 and 2, when the latch mechanism 20, and correspondingly the top of the window sash 12, 14, is released from the side jamb 16.

Figure 3:
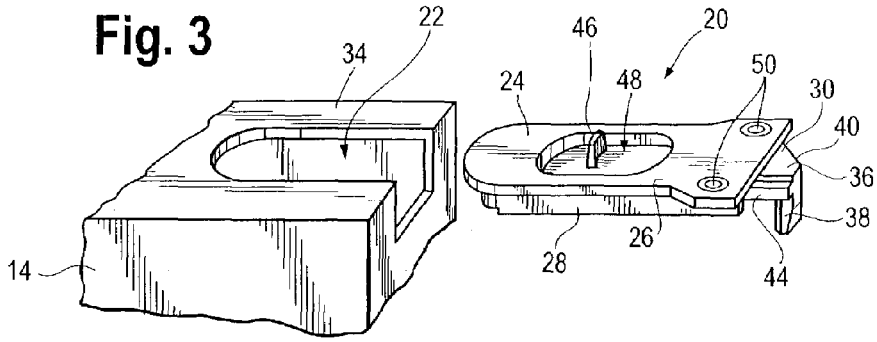
FIG. 3 is a partial perspective view of a corner of a window sash and a tilt latch mechanism, in accordance with the present invention, which couples to a notch cut into the top rail of the window sash.

FIG. 3 illustrates a partial perspective view of a corner of a window sash 14 and a tilt latch mechanism 20, in accordance with the present invention. The tilt latch mechanism 20 couples to the window sash 14 via a notch 22 cut into the top rail of the window sash 14. In at least one embodiment of the present invention, the tilt latch mechanism 20 generally includes a main housing 24, and a bolt 30. The main housing 24 includes a top plate 26 and one or more side walls 28, which extend from the top plate 26. The bolt 30 travels within a channel 32, that is formed within the main housing 24 between the side walls 28. The channel 32 can be more readily seen in FIG. 6. The side walls 28 have at least one opening 34, which substantially coincides with one end of the channel 32. The bolt 30 has a first end 36, which is adapted for extending through the opening 34 and engaging the side jamb 16 of a window frame.

The bolt 30 has a protrusion 38, which projects from the first end 36 of the bolt 30, below a bottom surface of an external sidewall of the bolt 30 immediately adjacent to the protrusion 38 in the direction of travel of the window sash 14 within the window frame. In at least one embodiment, the first end 36 of the bolt 30, and the protrusion 38 projecting from the first end 36 of the bolt 30, to the extent that it shares an affected surface with the first end of the bolt, has an angled surface 40 on the side which, when extended, contacts the side jamb 16, when the window sash 14 moves from a tilted position to a non-tilted position. In the embodiment illustrated in FIGS. 1 and 2, the non-tilted position corresponds to the vertical position, and the tilted position corresponds to the horizontal and the intermediate angled positions.

Figure 8:
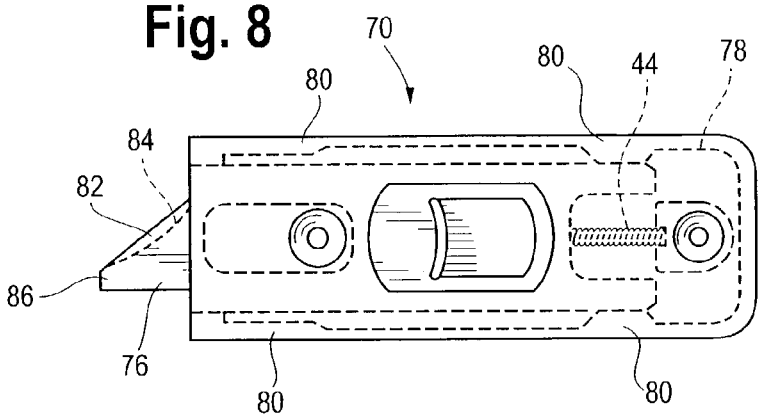
FIG. 8 is a top plan view of an alternative embodiment of a tilt latch mechanism in accordance with the present invention.

The angled surface 40, when it contacts the side jamb 16 will bias the end 36 of the bolt 30 into the main housing 24, against the force exerted by a tension device coupled between the bolt 30 and the side walls 28 of the main housing 24 at the side 42 of the channel 32 opposite the opening 34 in the channel 32. In at least one embodiment, the tension device is a spring 44, as illustrated in FIG. 8. The other side 46 of the first end 36 of the bolt 30, the side 46 which contacts the side jamb 16, when the window sash 14 moves from a non-tilted position to a tilted position, is substantially perpendicular to the side jamb 16. Contact between the substantially perpendicular side 44 and the side jamb 16, generally does not meaningfully bias the bolt 30 within the channel 32 of the main housing 24. In this way the window sash 14 remains locked in a non-tilted position until the latch mechanism 20 is manually released.

The manual release of the latch mechanism 20 can be facilitated by the user engaging or gripping the bolt 30 and applying a force, which biases the bolt away from the opening 34 and out of the jamb pocket of the side jamb 16. The user can grip the bolt 30 via a finger grip 46, coupled to, or integrated with the bolt 30, which extends through the opening 48 in the top plate 26 of the main housing 24. The force applied by the user needs to be sufficient to overcome the force exerted by the tension device, which biases the bolt 30 outward.

In the illustrated embodiment, the latch mechanism 20 is coupled to the top rail of the sash via a pair of fasteners (not shown), which extend through the mounting holes 50 in the top plate 26 of the main housing 24. In at least one embodiment the fasteners, are threaded fasteners, like screws. The latch mechanism 20 can also be retained by the material thickness of the top rail being captivated between the top plate 26 and a pair of tabs 52 extending outward from the side wall 28 of the main housing 24. The tabs have a top surface that can deflect downward to accommodate a certain degree of variance in the thickness of the material forming the top surface 54 of the top rail. At the ends of the top surface of the tabs are prongs 58, which can more readily engage and grip the material thickness of the top surface 54 of the top rail.

Figure 4:
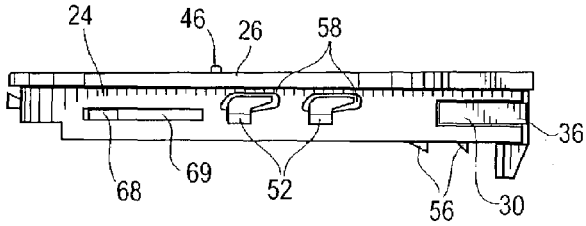
FIG. 4 is a side view of a tilt latch mechanism, in accordance with at least one embodiment of the present invention.
Figure 5:
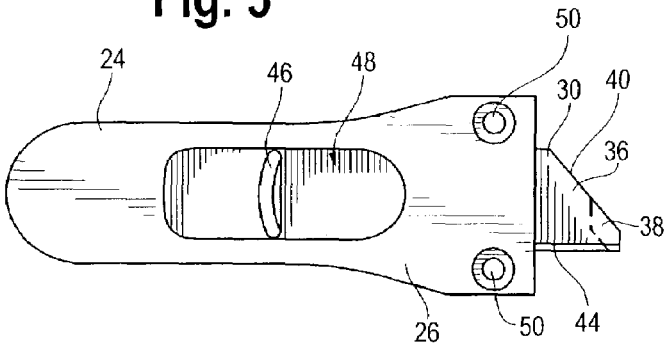
FIG. 5 is a plan view of the tilt latch mechanism, illustrated in FIGS. 3–4.

FIG. 4 illustrates a side view of a tilt latch mechanism, illustrated in FIG. 3, and FIG. 5 illustrates a plan view of the tilt latch mechanism, illustrated in FIGS. 3–4. From FIG. 4 it can be seen, that in at least one embodiment, a pair of prongs 56 extend downward from each of the side walls 28 of the main housing 24 to engage the bottom of the notch 22, and limit the ability of the latch mechanism 20 to back out of the window sash 14.

Figure 6:
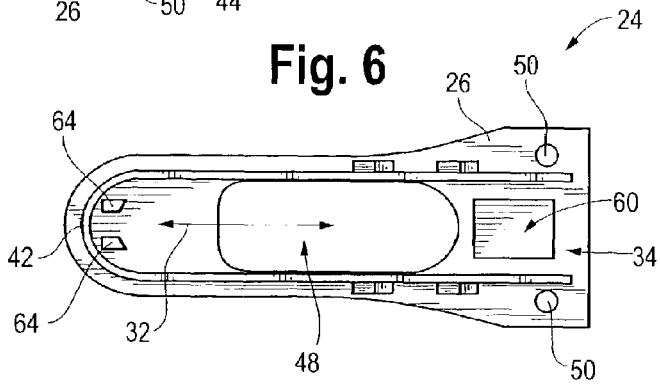
FIG. 6 is a bottom view of the main housing of the tilt latch mechanism, illustrated in FIGS. 3–5.
Figure 7:
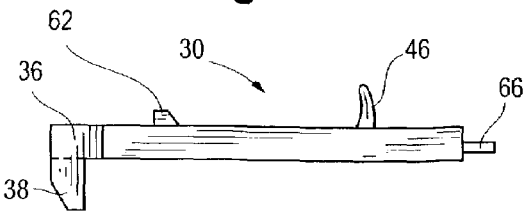
FIG. 7 is side view of a bolt for use with the main housing, illustrated in FIG. 6.

FIG. 6 is a bottom view of the main housing 24 of the tilt latch mechanism 20, illustrated in FIGS. 3–5. The bottom view of the main housing 24 additionally illustrates a pocket 60 formed in the underside of the top plate 26 of the main housing 24. The pocket 60 receives a tab 62, which projects upward from the bolt illustrated in FIG. 7, and which further illustrates a side view of the bolt 30 for use with the main housing 24, illustrated in FIG. 6. The tab 62 in combination with the pocket 60 limit the movement of the bolt 30 within the channel 32, both forward and backward. To accomodate the pocket 60, the thickness of the top plate 26 of the main housing 24 can be thicker proximate the end where the pocket 60 is formed.

Alternatively, wings 68 which extend from each side of the bolt 30 and a slot 69 which extends through the sidewall 26 of the main housing 24 could alternatively or additionally be used to limit the travel of the bolt 30 within the channel 32. Still further the wings could alternatively be associated with the side walls 26 of the main housing 24 and the slot could alternatively be associated with the bolt 30. Protrusions 64 at the end of the channel 32, which is opposite of the opening 34, facilitates coupling one end of the tension device to the main housing 24. The bolt 30 has a related protrusion 66 for coupling the other end of the tension device to the bolt 30.

Figure 9:
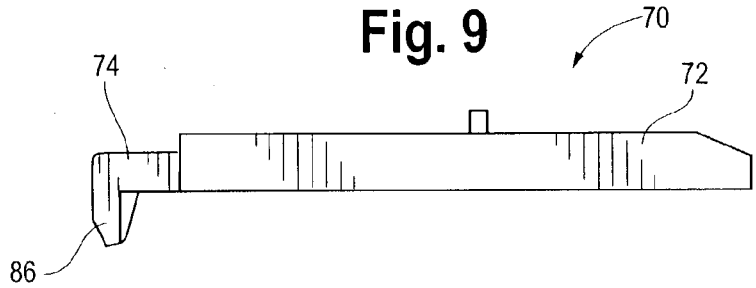
FIG. 9 is a side view of the tilt latch mechanism, illustrated in FIG. 8.

FIGS. 8 and 9 illustrate a top plan view and side view of an alternative embodiment of a tilt latch mechanism 70, in accordance with the present invention. The embodiment illustrated in FIGS. 8 and 9, is designed to couple directly to the top surface of the top rail. This embodiment of the present invention avoids the use of a notch 22, which in the other embodiment is cut into the top rail. The latch mechanism 70 illustrated in FIGS. 8 and 9, similarly has a main housing 72 and a bolt 74, which travels along a channel formed within the main housing 72, where one end of the bolt extends through an opening at one end of the main housing. However, in this embodiment, the bolt is retained within the housing via tabs 80, which fold under the bolt 74 from portions of the side wall 78 of the main housing 72.

The first end 76 of the bolt 74, in addition to showing a straight angled surface 82, additionally shows at least one possibility of a curved angled surface 84, using a dashed line. One skilled in the art will readily recognize, that other types of curved surfaces could alternatively be used, without departing from the teachings of the present invention. Similar to the embodiment illustrated in FIGS. 3 through 7, the first end 76 of the bolt 74 has a protrusion 86, which extends in the direction of travel of the window sash 12, 14, when the window sash 12, 14 is in a non-tilted orientation.

Figure 10:
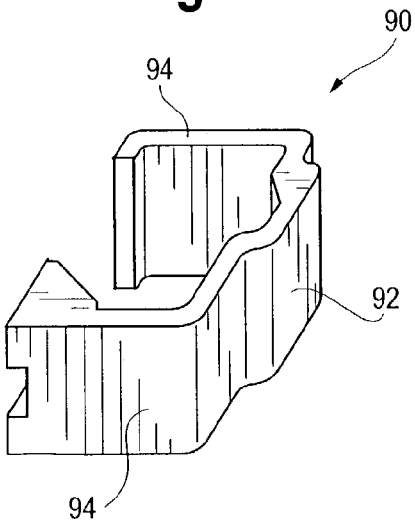
FIG. 10 is a perspective view of a pocket brace, in accordance with at least one aspect of the present invention.

The protrusions 38, 86, in both embodiments, are adapted for engaging a pocket brace 90 located in the jamb pocket 18 of the side jamb 16 of the window frame. A perspective view of a pocket brace 90, in accordance with at least one aspect of the present invention, is illustrated in FIG. 10.

The pocket brace 90 includes a cross member 92, which interrupts at least a portion of the channel opening of the jamb pocket 18. In the embodiment illustrated in FIGS. 10 and 11, the cross member 92 extends across the channel opening 96 of the jamb pocket 18. In the illustrated embodiment, extending from each end of the cross member 92 is a side flange 94, which extends around at least a portion of the interior surface of the jamb pocket 18 away from the channel opening 96.

In the illustrated embodiment, the pocket brace 90 is coupled to the jamb pocket 16 via a fastener 98 coupled to one end of one of the side flanges 94. This allows the unattached portion of the pocket brace to flex relative to the anchored end point. This further allows some of the energy that may result from extreme external weather conditions to be absorbed by the flexing of the pocket brace. Additionally, only coupling the pocket brace 90 at one end relaxes the dimensional tolerances of the other dimensions of the pocket brace 90 relative to the jamb pocket 18.

Figure 11:
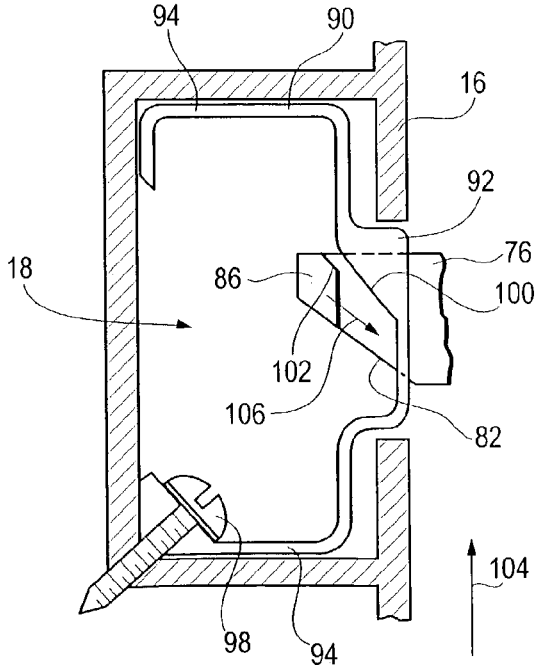
FIG. 11 is a partial sectional bottom plan view of the pocket brace installed in a jamb pocket of a side jamb.

As illustrated in FIG. 11, in at least one embodiment, the cross member has an angled surface 100, which corresponds to an angled contact surface 102 on the back side of the protrusion 86. The angled surfaces can interact with one another, such that a wind force 104 applied to the exterior surface of the window assembly, which causes the window sash 12, 14 to bow, thereby bringing the side edges of the window sash 12, 14 closer together, will cause the window sash to be biased in a direction 106 counter to the direction of the force 104 of the wind, and/or will bias the window sash further back along the ramped surface 100 biasing the side edges of the window sash 12, 14 further apart, thereby limiting any bowing of the window sash 12, 14.

Figure 13:
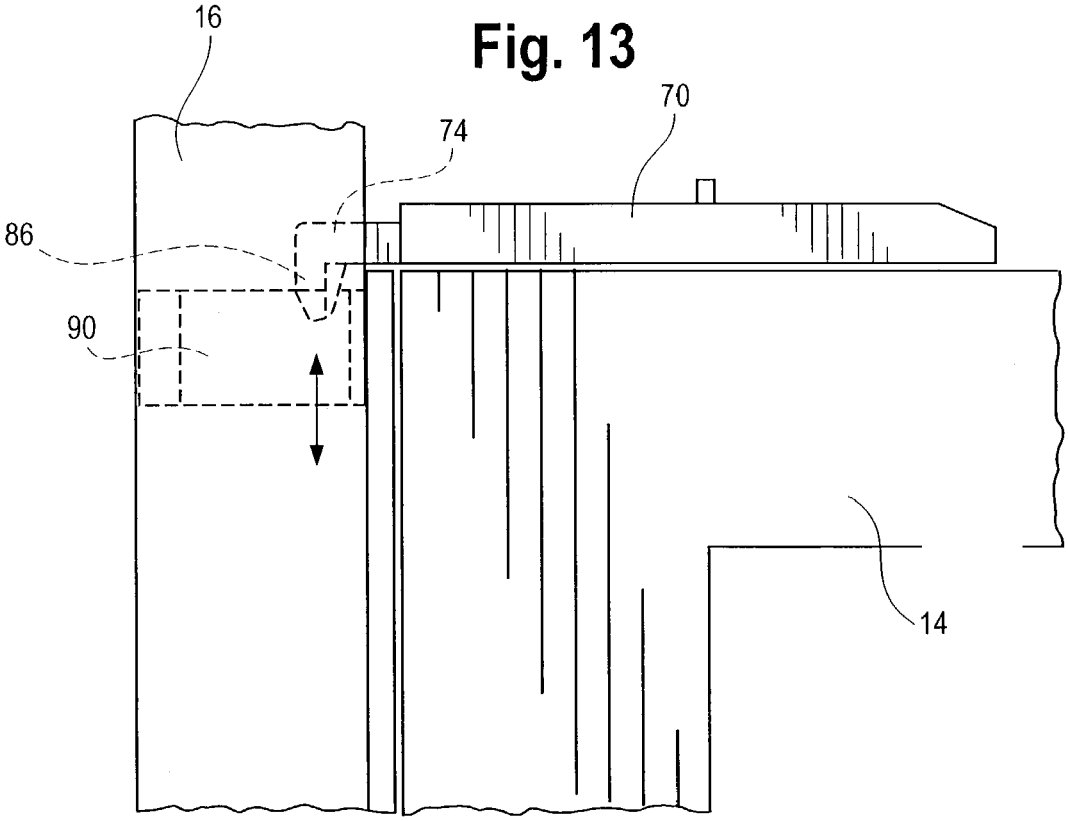
FIG. 13 is a partial front plan view of a window assembly proximate a corner of the window sash.

Additionally, when the protrusion is moved into an engaged position, relative to the pocket brace, as illustrated in FIG. 13, by moving the window sash downward, thereby dropping the protrusion 86 behind the pocket brace 90, the end 76 of the bolt 74 of the latch mechanism 70 needs to be displaced in at least two directions to disengage the bolt 74 from the side jamb 16.

Figure 12:
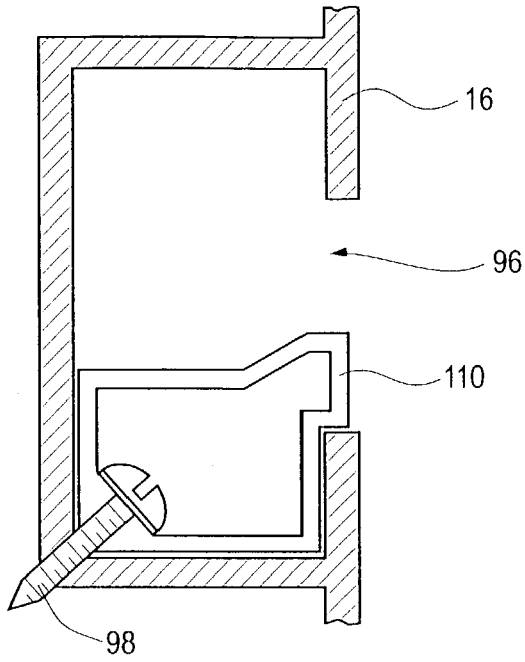
FIG. 12 is a partial sectional bottom plan view of an alternative embodiment of a pocket brace installed in a jamb pocket of a side jamb.

One skilled in the art will readily appreciate that other shapes for the pocket brace are possible without departing from the teachings of the present invention. One such alternative for a pocket brace 110 is illustrated in FIG. 12, which has a cross member that extends across only a portion of the channel opening 96 of the jamb pocket 18. This allows the pocket brace to avoid interfering with other activities occurring in other parts of the jamb pocket 18. However changes in the structure of the jamb pocket, may necessitate corresponding changes in the size and shape of the protrusion 86 extending from end 76 of the bolt 74. One skilled in the art will readily appreciate that the pocket brace could be integrated as part of the side jamb 16 and/or jamb pocket 18. One such approach may limit a cut that is made forming the channel opening 96 to a length that is at a height corresponding to the vertical movement of the protrusion between an engaged position and a disengaged position.

Lastly the height of the pocket brace 90 within the jamb pocket 18 can correspond to the height of the window sash 12, 14, when the window sash 12, 14 is in a closed position. In at least one embodiment, the physical height of the pocket brace 90 and/or the amount of overlap between the protrusion 86 and the pocket brace 90, may correspond to the required distance of travel for the window sash 14 to clear the window sill prior to being able to be tilted.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A latch mechanism adapted for being coupled to a window sash, which travels within a window frame, said latch mechanism comprising:

a main housing having a sidewall including one or more sidewall sections which extends around at least a portion of the housing and define an interior space, an opening in said sidewall at one end of said housing, said sidewall forming a channel within the interior space having an end that coincides with said opening;

a bolt substantially located within said housing and traveling along said channel, said bolt having a first end which is adapted for extending through the opening of said housing and extending into the side jamb of the window frame, said first end having a protrusion, relative to a bottom of the bolt, which projects in the direction of travel of the window sash, while in a non-tilt position, within the window frame;

a tension device coupled between the bolt and the main housing for biasing the bolt toward an extended position where the bolt extends at least partially through the opening; and wherein, as the window sash travels within the window frame, while in the non-tilt position relative to the window frame and the bolt is extended into the side jamb, the protrusion at the first end of said bolt moves between an engaged position, which restricts the bolt from being moved against the bias of the tension device to a non-extended position, and a disengaged position, which allows the bolt to be moved against the bias of the tension device to the non-extended position, relative to the window frame.

2. A latch mechanism in accordance with claim 1 wherein said protrusion projects in a downward direction, when the window sash is in the non-tilt position, and engages the window frame, when the window sash moves within the window frame toward a closed position.

3. A latch mechanism in accordance with claim 1 wherein said protrusion is adapted to engage a cross member, which interrupts at least a portion of a channel opening of a jamb pocket in a side jamb of the window frame, when the protrusion is in said engaged position relative to the window frame.

4. A latch mechanism in accordance with claim 3 wherein said channel opening extends along at least a portion of the length of the side jamb.

5. A latch mechanism in accordance with claim 3 wherein said protrusion engages said cross member, when said protrusion vertically overlaps the cross member.

6. A latch mechanism in accordance with claim 5 wherein the amount of vertical overlap between the protrusion and the cross member, when the window sash is in a closed position and the protrusion is engaged with the cross member, corresponds to the distance of travel from a closed position required for the bottom of a window sash to clear a sill located at the base of the window frame.

7. A latch mechanism in accordance with claim 3 wherein said bolt and corresponding protrusion have a common exterior surface, which is angled, and wherein when the window sash is moved between a tilted position and the non-tilt position, contact of the angled surface with the window frame biases the bolt to move in a direction which is into the main housing of the latch mechanism at least until the bolt of the latch coincides with the channel opening of a jamb pocket in a side jamb of the window frame.

8. A latch mechanism in accordance with claim 7 wherein the interior surface of the protrusion is angled in a direction which is consistent with the direction of the angled exterior surface of the protrusion.

9. A latch mechanism iii accordance with claim 8 wherein the angled interior surface of the protrusion is adapted to engage a corresponding angled interior contact surface of the cross member.

10. A latch mechanism in accordance with claim 3 wherein the interior surface of the protrusion and the interior contact surface of the cross member are angled in a direction, which biases the window sash in a direction opposite to an applied force, when the force is applied to an external facing surface of the window sash, and when the force is sufficient to bow the window sash and bring the sides of the window sash closer together.

11. A latch mechanism in accordance with claim 1 wherein said tension device is a spring.

12. A latch mechanism in accordance with claim 1 wherein when said window sash is in the non-tilt position and the first end of the bolt of the latch mechanism extends into the side jamb of the window frame, the first end of the bolt limits pivotal movement of the window sash with respect to the window frame.

13. A latch mechanism in accordance with claim 1 wherein said protrusion projects in a direction extending toward the side of the window frame associated with a sill located at the base of the window frame, when the window sash is in the non-tilt position, and engages the window frame, when the window sash moves within the window frame toward a closed position.

14. A method for supporting a window sash including a latch mechanism within a window frame comprising:

moving a window sash between an opened position and a closed position, while the window sash is in a non-tilt position relative to the window frame; and engaging a protrusion at the end of a bolt of a latch mechanism to a window frame when said window sash moves toward a closed position, while the window sash is substantially in plane with the direction of movement of the window sash arid the bolt is in an extended position extending into a side jamb of the window frame, wherein when engaged, the bolt is restricted from moving to a non-extended position.

15. A method in accordance with claim 14 wherein engaging a protrusion to a window frame includes engaging the protrusion at the end of the bolt behind a cross member extending across a channel opening of a jamb pocket of a side jamb of a window frame.

16. A method in accordance with claim 15 wherein, when an external force is applied to the window sash, any distortion of the window sash, which biases the sides of the window sash to move closer together, causes interacting angled contact surfaces of the protrusion and the cross member to generate a counter force applied to the window sash, which limits the distortion of the window sash.

17. A latch mechanism adapted for being coupled to a window sash, which travels within a window frame, said latch mechanism comprising:

a main housing having a sidewall including one or more sidewall sections which extends around at least a portion of the housing and define an interior space, an opening in said sidewall at one end of said housing, said sidewall forming a channel within the interior space having an end that coincides with said opening;

a bolt substantially located within said housing and traveling along said channel, said bolt having a first end which is adapted for extending through the opening of said housing, said first end having a protrusion, which projects below a bottom surface of an external sidewall of the bolt immediately adjacent the protrusion; and a tension device coupled between the bolt and the main housing for biasing the bolt toward an extended position where the bolt extends at least partially through the opening.

18. A latch mechanism in accordance with claim 17, wherein the first end of the bolt is adapted to extend into the side jamb of the window frame, and the protrusion is adapted to project in the direction of travel of the window sash, while in a non-tilt position, within the window frame, and wherein, as the window sash travels within the window frame, while in the non-tilt position relative to the window frame and the bolt is extended into the side jamb, the protrusion at the first end of said bolt moves between an engaged position, which restricts the bolt from being moved against the bias of the tension device to a non-extended position, and a disengaged position relative to the window frame, which allows the bolt to be moved against the bias of the tension device to the non-extended position.

* * * * *